US006460579B2

(12) United States Patent
Nanaji

(10) Patent No.: US 6,460,579 B2
(45) Date of Patent: Oct. 8, 2002

(54) VAPOR FLOW AND HYDROCARBON CONCENTRATION SENSOR FOR IMPROVED VAPOR RECOVERY IN FUEL DISPENSERS

(75) Inventor: Seifollah S. Nanaji, Greensboro, NC (US)

(73) Assignee: Gilbarco Inc., Greensboro, NC (US)

( * ) Notice: Subject to any disclaimer, the term of this patent is extended or adjusted under 35 U.S.C. 154(b) by 0 days.

(21) Appl. No.: 09/768,763

(22) Filed: Jan. 23, 2001

(65) Prior Publication Data

US 2001/0020493 A1 Sep. 13, 2001

Related U.S. Application Data

(63) Continuation-in-part of application No. 09/442,263, filed on Nov. 17, 1999.

(51) Int. Cl.[7] ..... B05B 31/00

(52) U.S. Cl. ..... 141/59; 141/7; 141/94

(58) Field of Search ..... 141/7, 44, 45, 141/59, 83, 94, 290

(56) References Cited

U.S. PATENT DOCUMENTS

| | | | | |
|---|---|---|---|---|
| 4,095,626 A | | 6/1978 | Healy | 141/206 |
| 4,508,127 A | | 4/1985 | Thurston | 137/8 |
| 4,949,755 A | | 8/1990 | Thurston et al. | 137/833 |
| 5,079,944 A | | 1/1992 | Boenning et al. | 73/23.4 |
| 5,127,173 A | | 7/1992 | Thurston et al. | 73/202 |
| 5,150,603 A | | 9/1992 | Boenning et al. | 73/31.05 |
| 5,156,199 A | | 10/1992 | Hartsell, Jr. et al. | 141/83 |
| 5,195,564 A | | 3/1993 | Spalding | 141/1 |
| 5,269,353 A | | 12/1993 | Nanaji et al. | 141/59 |
| 5,309,957 A | | 5/1994 | Saisuu | 141/83 |
| 5,323,817 A | | 6/1994 | Spalding | 141/1 |
| 5,332,008 A | | 7/1994 | Todd et al. | 141/5 |
| 5,332,011 A | | 7/1994 | Spalding | 141/59 |
| 5,345,979 A | | 9/1994 | Tucker et al. | 141/1 |
| 5,355,915 A | | 10/1994 | Payne | 141/83 |
| 5,363,988 A | | 11/1994 | Saxton et al. | 222/14 |
| 5,373,822 A | | 12/1994 | Thompson | 123/520 |
| 5,417,256 A | | 5/1995 | Hartsell, Jr. et al. | 141/7 |
| 5,429,159 A | | 7/1995 | Tees et al. | 141/59 |
| 5,450,883 A | | 9/1995 | Payne et al. | 141/59 |
| 5,464,466 A | | 11/1995 | Nanaji et al. | 95/45 |
| 5,507,325 A | * | 4/1996 | Finlayson | 141/83 |
| RE35,238 E | | 5/1996 | Pope | 141/59 |
| 5,515,714 A | | 5/1996 | Sultan et al. | 73/25.01 |
| 5,571,310 A | | 11/1996 | Nanaji | 96/4 |
| 5,592,979 A | * | 1/1997 | Payne et al. | 141/59 |
| 5,626,649 A | | 5/1997 | Nanaji | 95/12 |
| 5,629,477 A | | 5/1997 | Ito | 73/118.1 |
| 5,644,069 A | | 7/1997 | Liu et al. | 73/23.2 |
| 5,671,785 A | | 9/1997 | Andersson | 141/59 |
| 5,673,732 A | | 10/1997 | Kenney et al. | 141/59 |
| 5,675,073 A | | 10/1997 | Otsuka | 73/40.5 R |
| 5,706,871 A | | 1/1998 | Andersson et al. | 141/59 |

(List continued on next page.)

FOREIGN PATENT DOCUMENTS

| | | |
|---|---|---|
| EP | 065376 A1 | 4/1982 |
| EP | 0652276 A1 | 5/1994 |
| WO | WO 98/31628 | 7/1998 |
| WO | WO 00/50850 | 8/2000 |

*Primary Examiner*—Gregory L. Huson
*Assistant Examiner*—Peter deVore
(74) *Attorney, Agent, or Firm*—Withrow & Terranova PLLC

(57) ABSTRACT

A fuel dispenser includes vapor and hydrocarbon concentration sensors positioned in the vapor recovery line to calculate the vapor-to-liquid (V/L) ratio of the fuel dispenser. If the V/L ratio is not as desired, an adjustment is made to attempt a correction of the V/L ratio. If such correction attempt is unsuccessful, and error is reported.

28 Claims, 16 Drawing Sheets

U.S. PATENT DOCUMENTS

| | | | | |
|---|---|---|---|---|
| 5,715,875 | A | | 2/1998 | Clary et al. ..... 141/59 |
| 5,726,354 | A | | 3/1998 | Momura et al. ..... 73/118.1 |
| 5,753,933 | A | | 5/1998 | Morimoto ..... 257/14 |
| 5,755,854 | A | | 5/1998 | Nanaji ..... 95/11 |
| 5,765,603 | A | | 6/1998 | Healy ..... 141/59 |
| 5,769,134 | A | | 6/1998 | Kenney et al. ..... 141/59 |
| 5,779,097 | A | | 7/1998 | Olson et al. ..... 222/39 |
| 5,782,275 | A | | 7/1998 | Hartsell, Jr. et al. ..... 141/94 |
| 5,832,967 | A | | 11/1998 | Andersson ..... 141/59 |
| 5,850,857 | A | * | 12/1998 | Simpson ..... 141/59 |
| 5,857,500 | A | | 1/1999 | Payne et al. ..... 141/59 |
| 5,860,457 | A | | 1/1999 | Andersson ..... 141/59 |
| 5,913,343 | A | | 6/1999 | Andersson ..... 141/59 |
| 5,944,067 | A | | 8/1999 | Andersson ..... 141/59 |
| 5,988,232 | A | | 11/1999 | Koch et al. ..... 141/59 |
| 6,244,310 | B1 | * | 6/2001 | Rowland et al. ..... 141/59 |

* cited by examiner

VAPOR FLOW AND HYDROCARBON CONCENTRATION SENSOR FOR IMPROVED VAPOR RECOVERY IN FUEL DISPENSERS

RELATED APPLICATION

This application is a continuation-in-part application of Ser. No. 09/442,263, entitled "VAPOR FLOW AND HYDROCARBON CONCENTRATION SENSOR FOR IMPROVED VAPOR RECOVERY IN FUEL DISPENSERS," filed on 11/17/1999.

BACKGROUND OF THE INVENTION

1. Field of the Invention

The present invention is directed to vapor flow and hydrocarbon concentration sensors that are positioned in a vapor recovery line for a fuel dispenser.

2. Description of the Prior Art

Vapor recovery equipped fuel dispensers, particularly gasoline dispensers, have been known for quite some time, and have been mandatory in California for a number of years. The primary purpose of using vapor recovery is to retrieve or recover the vapors, which would otherwise be emitted to the atmosphere during a fueling operation, particularly for motor vehicles. The vapors of concern are generally those which are contained in the vehicle gas tank. As liquid gasoline is pumped into the tank, the vapor is displaced and forced out through the filler pipe. Other volatile hydrocarbon liquids raise similar issues. In addition to the need to recover vapors, some states, California in particular, are requiring extensive reports about the efficiency with which vapor is recovered.

A traditional vapor recovery system is known as the "balance" system, in which a sheath or boot encircles the liquid fueling spout and connects by tubing back to the fuel reservoir. As the liquid enters the tank, the vapor is forced into the sheath and back toward the fuel reservoir or underground storage tank (UST) where the vapors can be stored or recondensed. Balance systems have numerous drawbacks, including cumbersomeness, difficulty of use, ineffectiveness when seals are poorly made, and slow fueling rates.

As a dramatic step to improve on the balance systems, Gilbarco, Inc., assignee of the present invention, patented an improved vapor recovery system for fuel dispensers, as seen in U.S. Pat. No. 5,040,577, now Reissue Pat. No. 35,238 to Pope, which is herein incorporated by reference. The Pope patent discloses a vapor recovery apparatus in which a vapor pump is introduced in the vapor return line and is driven by a variable speed motor. The liquid flow line includes a pulser, conventionally used for generating pulses indicative of the liquid fuel being pumped. This permits computation of the total sale and the display of the volume of liquid dispensed and the cost in a conventional display, such as, for example as shown in U.S. Pat. No. 4,122,524 to McCrory et al. A microprocessor translates the pulses indicative of the liquid flow rate into a desired vapor pump operating rate. The effect is to permit the vapor to be pumped at a rate correlated with the liquid flow rate so that, as liquid is pumped faster, vapor is also pumped faster.

There are three basic embodiments used to control vapor flow during fueling operations. The first embodiment is the use of a constant speed vapor pump during fueling without any sort of control mechanism. The second is the use of a pump driven by a constant speed motor coupled with a controllable valve to extract vapor from the vehicle gas tank. While the speed of the pump is constant, the valve may be adjusted to increase or decrease the flow of vapor. The third is the use of a variable speed motor and pump as described in the Pope patent, which is used without a controllable valve assembly. All three techniques have advantages either in terms of cost or effectiveness, and depending on the reasons driving the installation, any of the three may be appropriate, however none of the three systems, or the balance system are able to provide all the diagnostic information being required in some states. The present state of the art is well shown in commonly owned U.S. Pat. No. 5,345,979, which is herein incorporated by reference.

Regardless of whether the pump is driven by a constant speed motor or a variable speed motor, there is no feedback mechanism to guarantee that the amount of vapor being returned to the UST is correct. A feedback mechanism is helpful to control the A/L ratio. The A/L ratio is the amount of vapor-Air being returned to the UST divided by the amount of Liquid being dispensed. An A/L ratio of 1 would mean that there was a perfect exchange. Often, systems have an A/L>1 to ensure that excess air is recovered rather than allowing some vapor to escape. This inflated A/L ratio causes excess air to be pumped into the UST, which results in a pressure build up therein. This pressure build up can be hazardous, and as a result most USTs have a vent that releases vapor-air mixtures resident in the UST to the atmosphere should the pressure within the UST exceed a predetermined threshold. While effective to relieve the pressure, it does allow hydrocarbons or other volatile vapors to escape into the atmosphere.

While PCT application Ser. No. PCT/GB98/00172 published Jul. 23, 1998 as WO 98/31628, discloses one method to create a feedback loop using a Fleisch tube, there remains a need to create alternate feedback mechanisms to measure the vapor flow in a vapor recovery system. Specifically, the feedback needs to not only tell the fuel dispenser how fast vapor is being recovered, but also how efficiently the vapor is being recovered. To do this, the feedback mechanism needs to monitor vapor flow and hydrocarbon concentration in the vapor return path. Not only should the feedback mechanism improve the efficiency of the vapor recovery operation, but also the feedback mechanism should be able to report the information being required by California's increased reporting requirements.

SUMMARY

The deficiencies of the prior art are addressed by providing a vapor flow sensor and a hydrocarbon concentration sensor in a vapor return line for a fuel dispenser. As used herein a "hydrocarbon sensor" includes sensors that directly measure the concentration of hydrocarbons as well as sensors that indirectly measure the concentration of hydrocarbons, such as by measuring oxygen concentration. The combination of sensors allows more accurate detection of hydrocarbons being recovered by the vapor recovery system. This is particularly helpful in determining if an Onboard Recovery Vapor Recovery (ORVR) system is present in the vehicle being fueled. When an ORVR system is detected, the vapor recovery system in the fuel dispenser may be turned off or slowed to retrieve fewer vapors so as to avoid competition with the ORVR system. Additionally, the combined sensor allows a number of diagnostic tests to be performed which heretofore were not possible.

The combination of sensors may be positioned in a number of different locations in the vapor recovery line, or even in the vent path for the Underground Storage Tank (UST). The exact position may determine which diagnostic tests may be performed, however, the sensors should allow a number of diagnostic tests regardless of position. In this manner data may be collected to comply with the California Air Resources Board (CARB) regulations.

In one embodiment, the fuel dispenser determines if the V/L ratio is within an acceptable range. If not, the fuel dispenser adjusts the vapor recovery system, if possible, to bring its V/L ratio into an acceptable range. If not possible, an error is generated.

In another embodiment, the fuel dispenser calculates successive V/L ratios. If two or more successive V/L ratios, depending on desired number of successive V/L ratios programmed, are outside an acceptable range of V/L ratios, the fuel dispenser adjusts the vapor recovery system, if possible, to bring its V/L ratio into an acceptable range. If not possible, an error is generated.

In another embodiment, the fuel dispenser calculates V/L ratios over time and compares such ratios to a theoretical pattern of acceptable V/L ratios. If the calculated V/L ratios deviate from the pattern, the fuel dispenser adjusts the vapor recovery system, if possible, to bring its V/L ratio into an acceptable range. If not possible, an error is generated.

DETAILED DESCRIPTION OF THE PREFERRED EMBODIMENTS

The present invention lies in including a hydrocarbon sensor and vapor flow sensor within a fuel dispenser and using the combination to provide accurate diagnostic readings about the nature of the vapor being recovered in the vapor recovery system of the fuel dispenser. Additionally, the diagnostics will indicate whether the vapor recovery system is performing properly. As used herein a "hydrocarbon sensor" includes sensors that directly measure the concentration of hydrocarbons as well as sensors that indirectly measure the concentration of hydrocarbons. The latter type of sensor might include oxygen concentration sensors or nitrogen sensors. Taking the inverse of the measurement provides an indication of hydrocarbon concentration. For example, total gas minus measured nitrogen provides an approximate hydrocarbon concentration. Such sensors could, through calibration, provide accurate measurements of hydrocarbon concentrations in the vapor recovery line.

Figure 1:
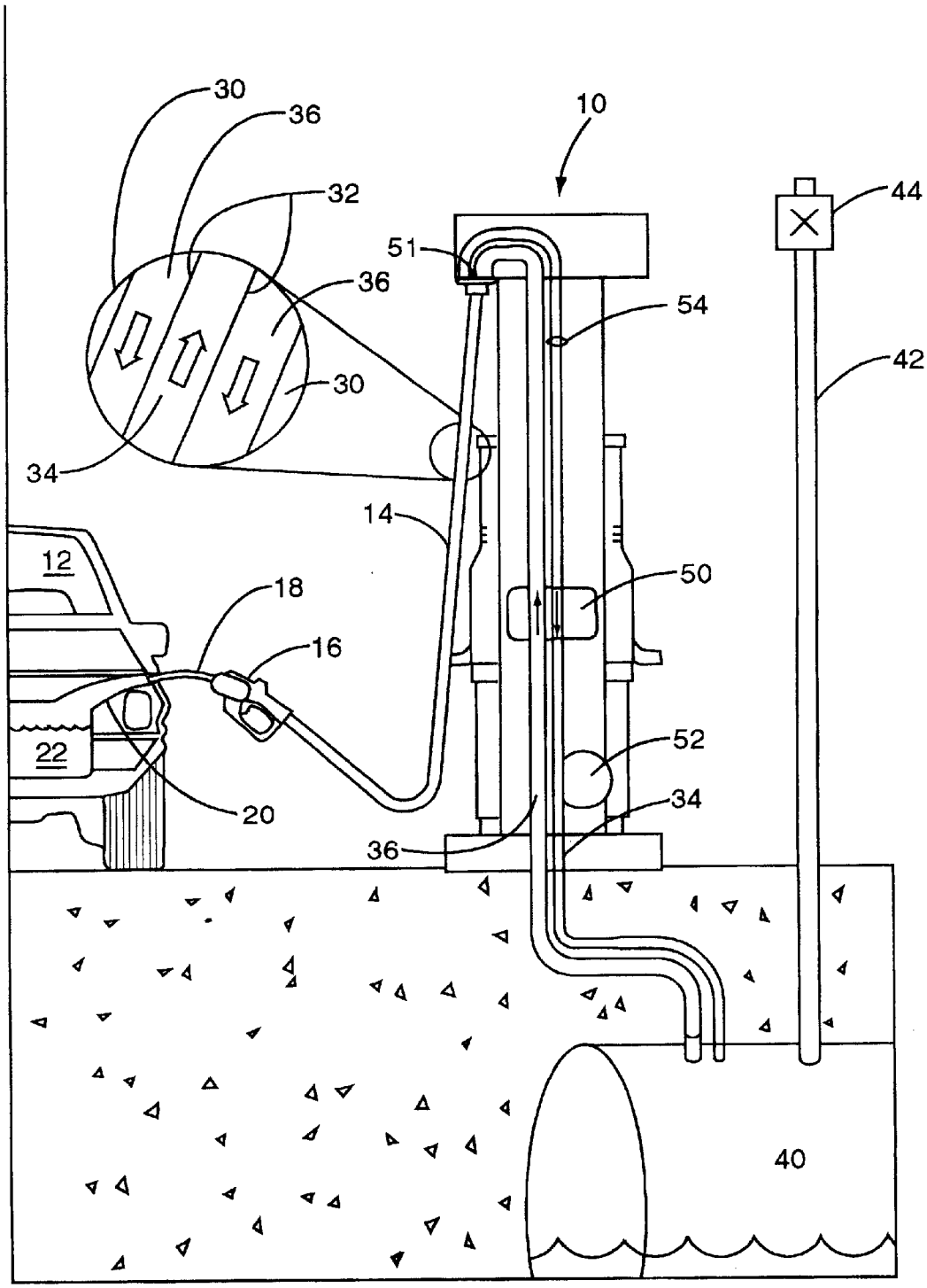
FIG. 1 is a simplified schematic of a fuel dispenser of the present invention.

Turning now to FIG. 1, a fuel dispenser 10 is adapted to deliver a fuel, such as gasoline or diesel fuel to a vehicle 12 through a delivery hose 14, and more particularly through a bootless nozzle 16 and spout 18. The vehicle 12 includes a fill neck 20 and a tank 22, which accepts the fuel and provides it through appropriate fluid connections to the engine (not shown) of the vehicle 12.

Presently, it is known in the field of vapor recovery to provide the flexible delivery hose 14 with an outer conduit 30 and an inner conduit 32. The annular chamber formed between the inner and outer conduits 30, 32 forms the product delivery line 36. The interior of the inner conduit 32 forms the vapor return line 34. Both lines 34 and 36 are fluidly connected to an underground storage tank (UST) 40 through the fuel dispenser 10. Once in the fuel dispenser 10, the lines 34 and 36 separate at split 51. The UST 40 is equipped with a vent shaft 42 and a vent valve 44. During delivery of fuel into the tank 22, the incoming fuel displaces air containing fuel vapors. The vapors travel through the vapor return line 34 to the UST 40.

A vapor recovery system is typically present in the fuel dispenser 10 and includes a control system 50 and a vapor recovery pump 52. The control system 50 may be a microprocessor with an associated memory or the like and also operates to control the various functions of the fuel dispenser including, but not limited to: fuel transaction authorization, fuel grade selection, display and/or audio control. The vapor recovery pump 52 may be a variable speed pump or a constant speed pump with or without a controlled valve (not shown) as is well known in the art. A "combined sensor" 54 is positioned in the vapor recovery line 34 upstream of the pump 52, and is communicatively connected to the control system 50. The "combined sensor" 54 is a hydrocarbon concentration sensor and a vapor flow monitor proximate one another or integrated together in any fashion to monitor vapor flow rates and hydrocarbon concentrations in the vapor return path. Further, a matrix of sensors could be used to provide improved accuracy. Sensor 54 is discussed in greater detail below.

Figure 2:
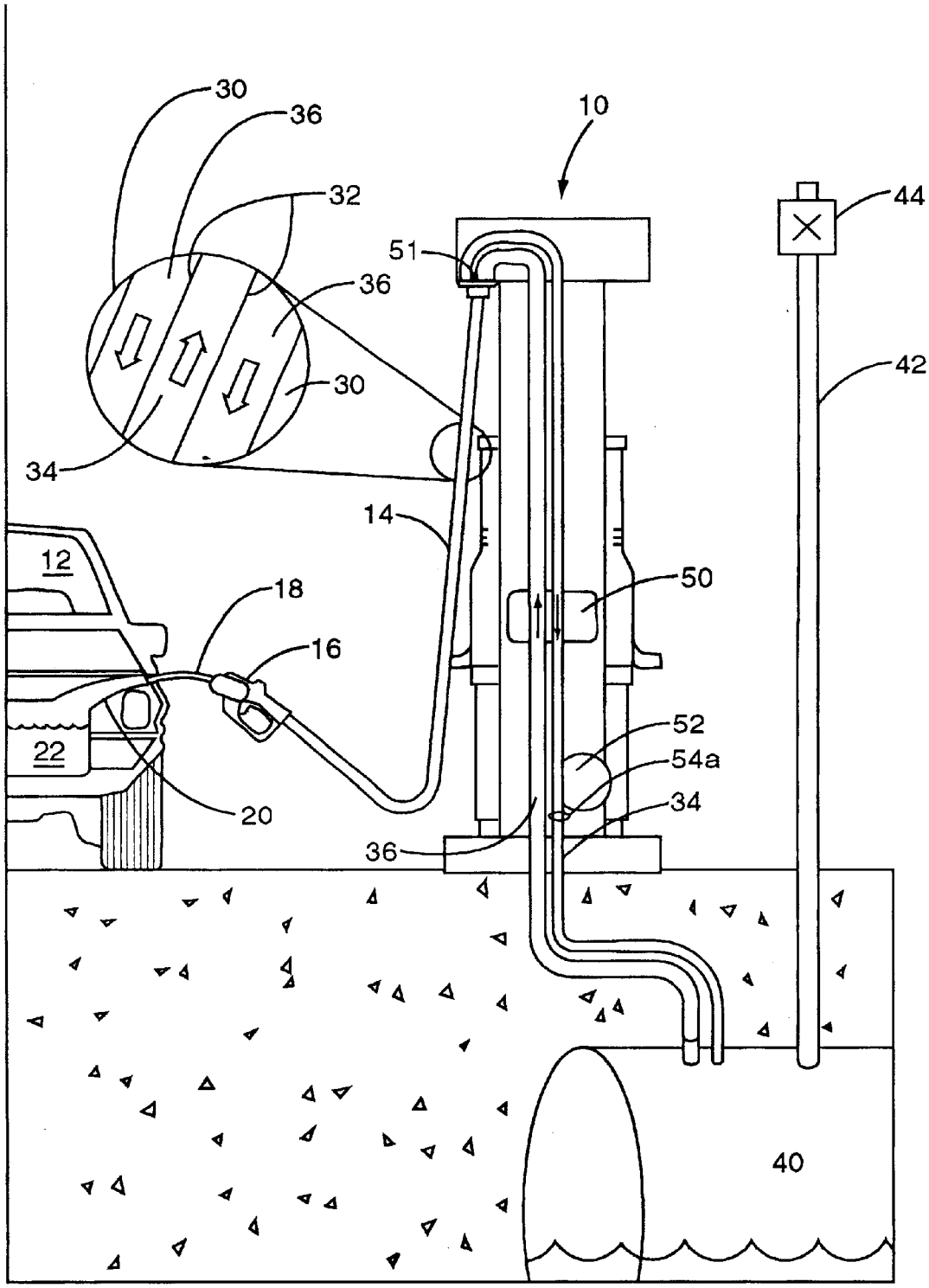
FIG. 2 is a simplified schematic of an alternate embodiment of the present invention.

An alternate location of the combined sensor is seen in FIG. 2, wherein the sensor 54*a* is located downstream of the vapor pump 52. In all other material aspects, the fuel dispenser 10 remains the same.

Figure 3:
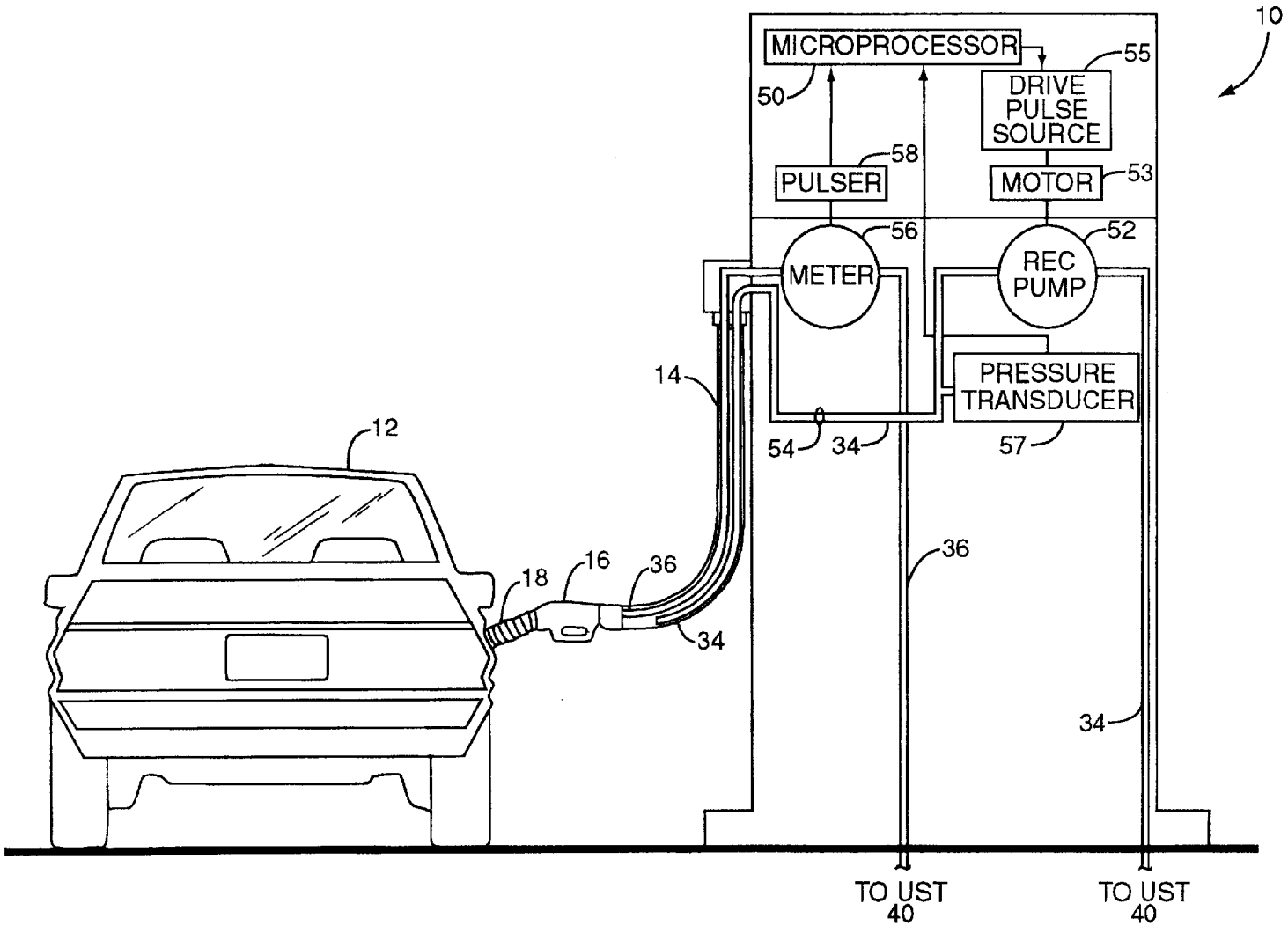
FIGS. 3 and 4 are simplified schematics of a Pope type system with alternate placements of the sensors of the present invention therein.
Figure 4:
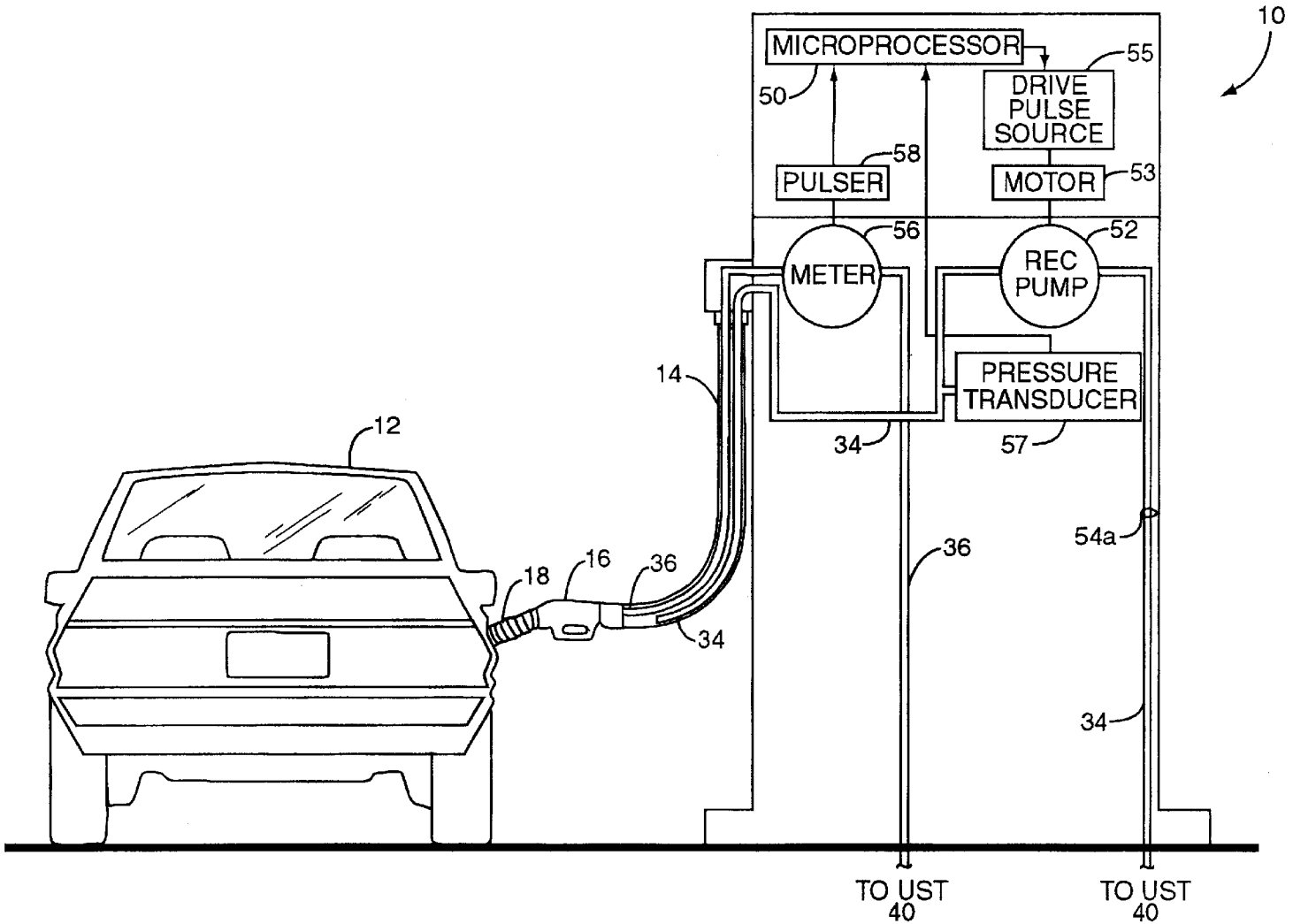

Similarly, because fuel dispensers may differ, the combined sensor 54 of the present invention is easily adaptable to a number of different locations within a fuel dispenser 10 as seen in FIGS. 3 and 4. FIGS. 3 and 4 represent fuel dispensers such as were disclosed in the original Pope patent discussed above. The fundamental principle remains the same, but because the layout of the interior components is different from that disclosed in FIGS. 1 and 2, the components will be explained again. Fuel, such as gas is pumped from a UST 40 through a fuel delivery line 36 to a nozzle 16 and thence through a spout 18 to a vehicle 12 being fueled. Vapor is recovered from the gas tank of vehicle 12 through a vapor recovery line 34 with the assistance of a vapor pump 52. A motor 53 powers the vapor pump 52. A control system 50 receives information from a pressure transducer 57 in the vapor return line 34 as well as information from a meter 56 and a pulser 58 in the fuel delivery line 36. The meter 56 measures the fuel being dispensed while the pulser 58 generates a pulse per count of the meter 56. Typical pulsers 58 generate one thousand (1000) pulses per gallon of fuel dispensed. Control system 50 controls a drive pulse source 55 that in turn controls the motor 53. While some of these elements are not disclosed in FIGS. 1 and 2, the fuel dispensers of FIGS. 1 and 2 operate on the same principles. FIG. 3 shows the combined sensor 54 upstream of the pump 52, while FIG. 4 shows the combined sensor 54*a* placed downstream of the pump 52. Again, it should be appreciated that the pump 52 can be a variable speed pump or a constant speed pump with a controlled valve which together control the rate of vapor recovery.

Figure 5:
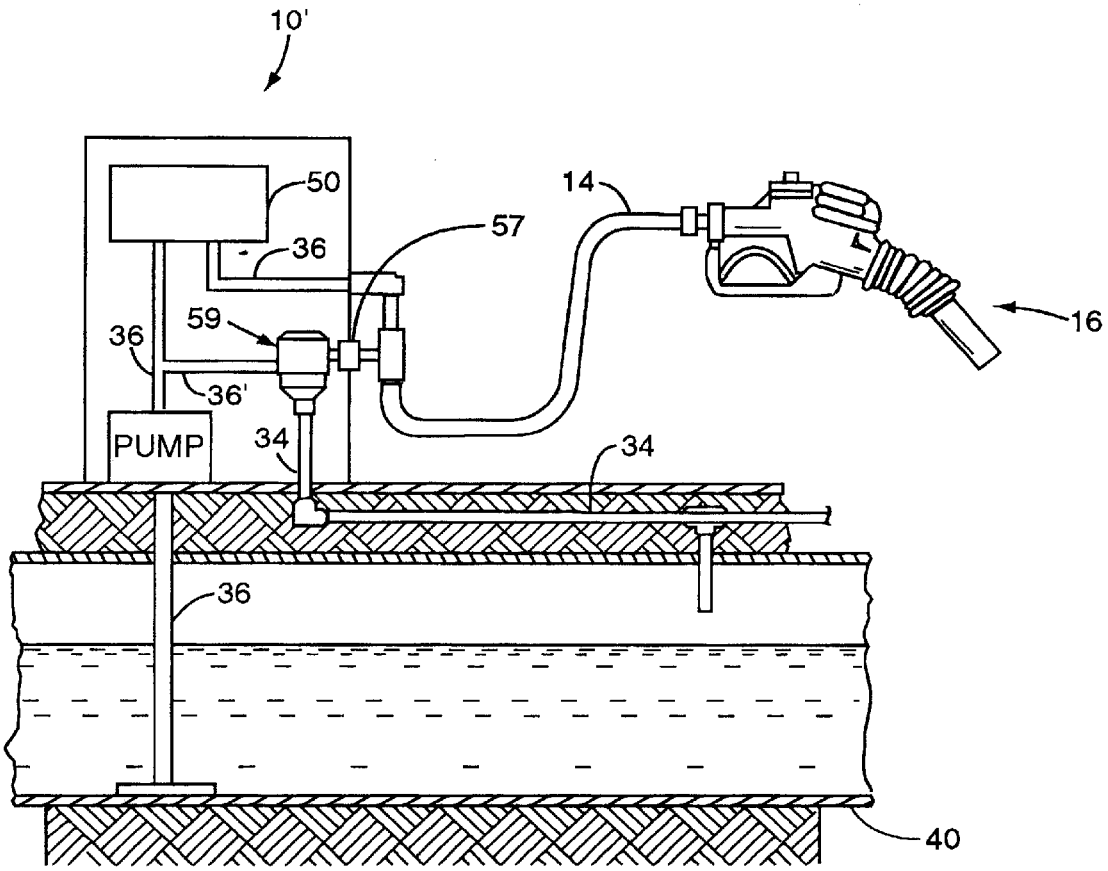
FIG. 5 is a simplified schematic of a Healy type system with the sensors of the present invention disposed therein.

Another vapor recovery system was originally disclosed by Healy in U.S. Pat. No. 4,095,626, which is herein incorporated by reference. The present invention is also well suited for use with the Healy vapor recovery system. As shown in FIG. 5, the Healy fuel dispenser 10' includes a fuel delivery line 36 which splits and directs a portion of the fuel being delivered to a liquid jet gas pump 59 via line 36'. Fuel is delivered conventionally through hose 14 and nozzle 16. A vacuum is created on the hose side of the liquid jet gas pump 59 that sucks vapor from the vehicle gas tank 22 (FIG. 1) through combined sensor 54 on to the UST 40 via recovery line 34. Because the liquid jet gas pump 59 directs liquid fuel through the return line 34 during the creation of a vacuum therein, the combined sensor 54 must be upstream of the pump 59 to ensure accurate readings.

While placing the combined sensor 54 in the fuel dispenser 10 allows feedback to be gathered about the vapor recovered in the actual fueling environment, there may be occasions wherein the ventilation system of the UST 40 needs to be monitored. Combined sensor 54 is well suited for placement in various ventilation systems. Such placement might be appropriate where concerns existed about the emissions therefrom to reduce pressure in the UST 40. As state and federal regulations tighten about what sort of emissions are allowable, the placement of a combined sensor 54 in the ventilation system may provide valuable information about the level of scrubbers or filters needed to comply with the regulations.

Figure 6:
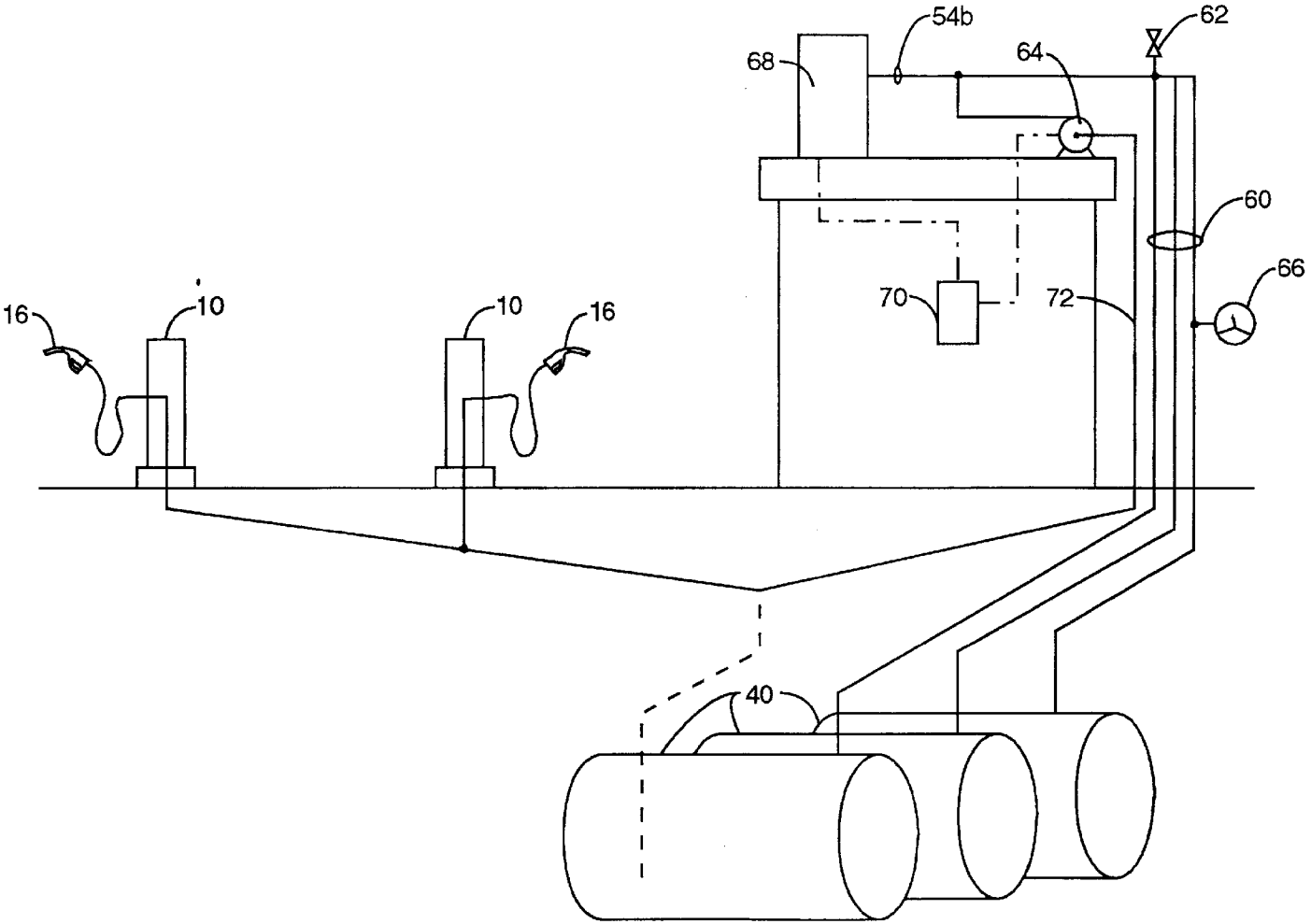
FIGS. 6–8 are alternate placements in a Hasstech type system.
Figure 7:
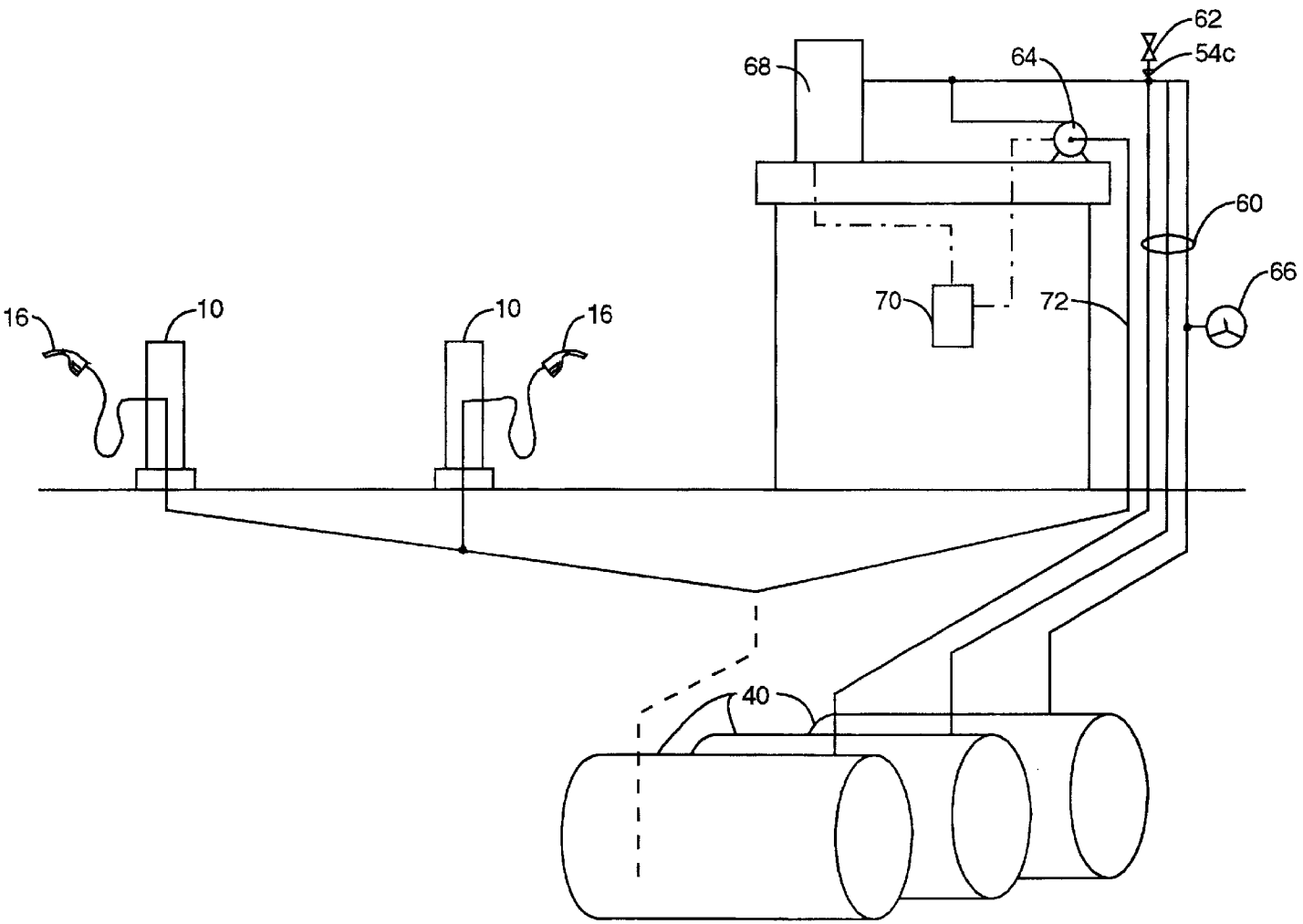
Figure 8:
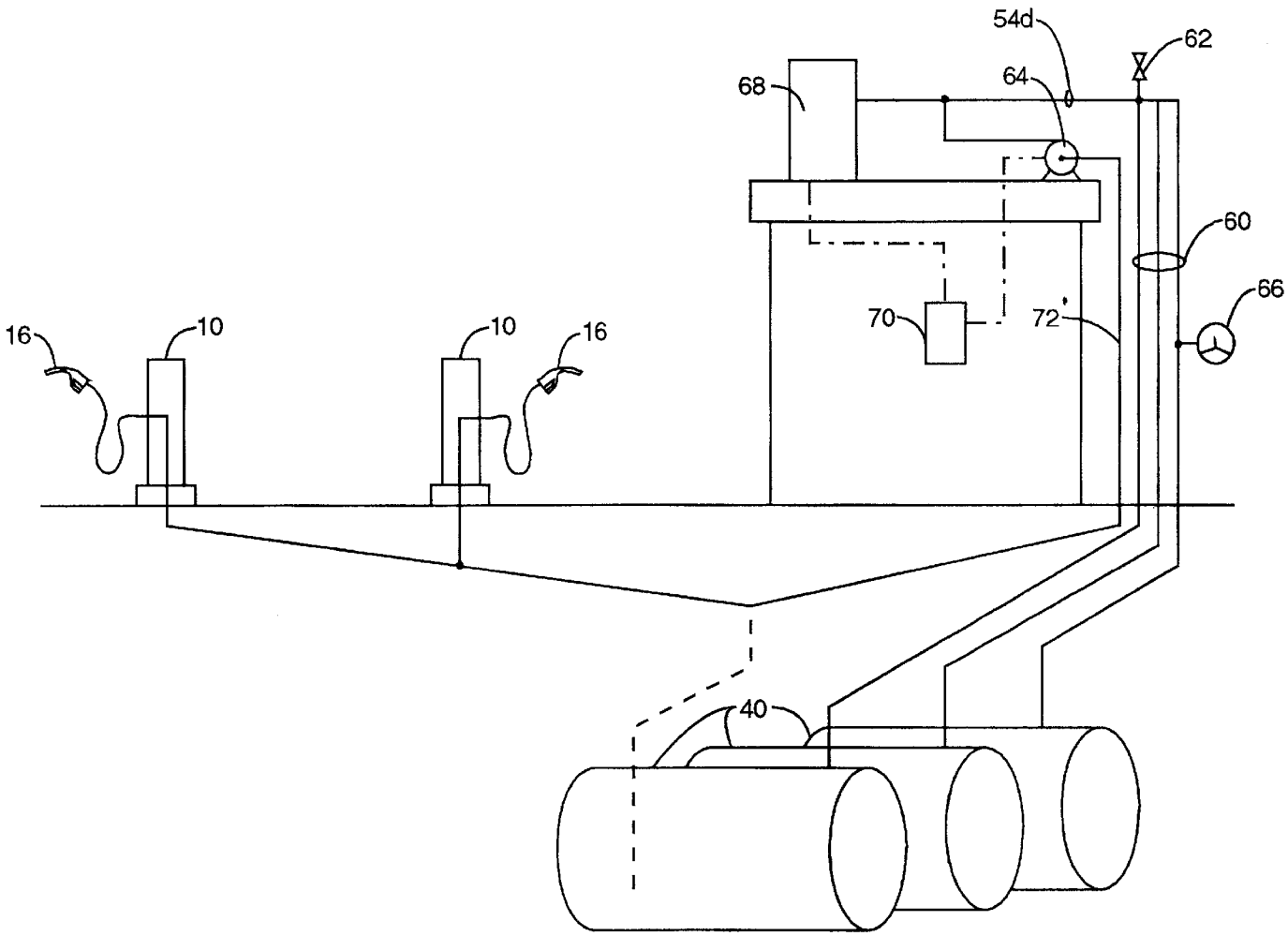

Combined sensor 54 can be positioned in the ventilation lines as better seen in FIGS. 6–8.

While FIGS. 6–8 represent Hasstech type systems, sold by Hasstech, Inc., 6985 Flanders Drive, San Diego, Calif. 92121, other comparable ventilation systems are also contemplated. Fuel dispensers 10 send vapor from nozzles 16 back to a plurality of USTs 40 with the assistance of a vapor pump 52 as previously explained. However, as shown, a single vapor pump 64 may be centrally positioned and draws vapor from each dispenser 10. This positioning is in contrast to the positioning of an individual vapor pump 52 in each dispenser 10 as previously shown. Either system is equally suited for use with the present invention. Vent lines 60 each vent a different one of the USTs 40 through a Pressure/Vapor (P/V) valve 62. The vent lines 60 and valve 62 are designed to relieve pressure build up in the USTs 40. A tank correction gauge 66 may be placed in one or more of the vent lines 60. A processing unit 68 may be provided to filter some of the hydrocarbons from the gas being vented to comply with emissions laws. In the particular Hasstech system shown, the processing unit 68 acts to burn out hydrocarbons prior to expulsion of the vapor into the atmosphere.

Since the vapor pump 52 is positioned on the roof of the gas station, vapor line 72 provides vacuum power from the pump 52 to the fuel dispensers 10. An electrical control panel 70 controls the operation of the vapor pump 64 and the processing unit 68. Improving on the original Hasstech system, a combined sensor 54*b* is placed in the venting system. The combined sensor 54*b* may be placed between the vapor pump 64 and the processing unit 68 to determine what sort of vapor is being fed to the processing unit 68. This information may be useful in determining how much scrubbing the processing unit 68 must perform.

Alternately, a combined sensor 54*c* can be placed immediately upstream of the valve 62 as seen in FIG. 7. This position may be helpful in determining exactly what vapors are being released to the atmosphere. Still further, a combined sensor 54*d* can be placed between the valve 62 and the vapor pump 64 as seen in FIG. 8. This may tell what sort of vapor is present in the UST 40 that needs to be vented. Furthermore, a combination of combined sensors 54*b*–54*d* and their corresponding positions could be used together to determine how efficiently the processing unit 68 was removing hydrocarbons, or exactly what was being vented through valve 62.

Figure 13:
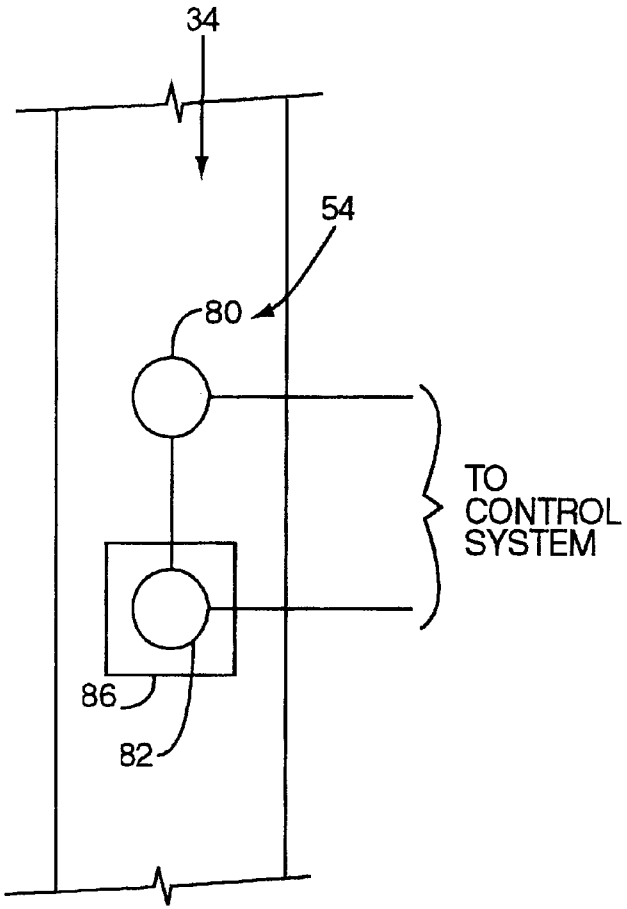
FIGS. 12 and 13 are possible embodiments of the sensors as removed from the vapor recovery system.
Figure 12:
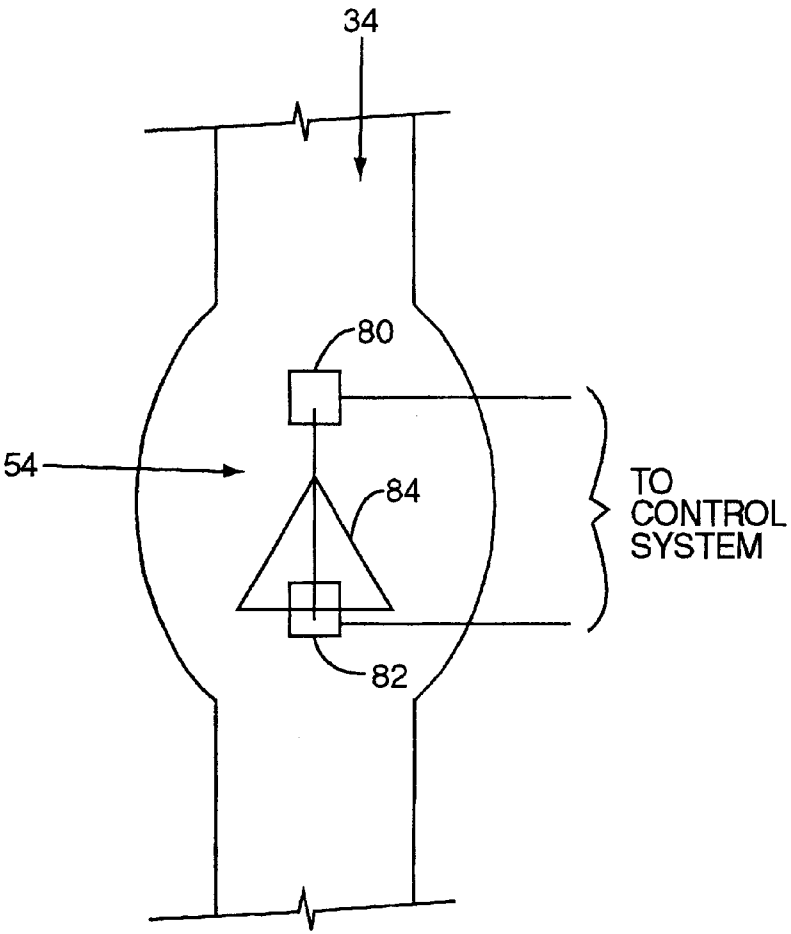

Combined sensor 54 is positioned in the vapor return line 34 or the ventilation system as shown in the previous figures and as shown in FIGS. 12 and 13. Combined sensor 54 is a combined vapor flow meter 80 and hydrocarbon concentration sensor 82. One implementation of combined sensor 54 is an integrated sensor which acts as both a hydrocarbon sensor and a flow rate monitor. However, proximate positioning of two discrete sensors is also contemplated and intended to be within the scope of the present invention. Appropriate hydrocarbon sensors 82 include those disclosed in U.S. Pat. No. 5,782,275, which is herein incorporated by reference or that sold under the trademark ADSISTOR by Adsistor Technology, Inc. of Seattle, Wash. Note also that under the broad definition of hydrocarbon sensor as used herein, other sensors may also be appropriate. In FIG. 12, the hydrocarbon sensor 82 is protected from inadvertent exposure to liquid hydrocarbons by liquid shield 84, which directs liquid flow away from the sensor, but allows gaseous hydrocarbons or air to still provide accurate readings on the sensor 82. Vapor flow sensor 80 may be a sensor such as disclosed in commonly owned co-pending application serial no. 09/408,292, filed Sep. 23, 1999, which is herein incorporated by reference, or other equivalent vapor flow sensor.

In contrast, as shown in FIG. 13, the hydrocarbon sensor 82 may be positioned in a membrane 86 such as that disclosed in commonly owned U.S. Pat. Nos. 5,464,466; 5,571,310; and 5,626,649, which are herein incorporated by reference. Alternately, the membrane 86 could be one which allows gas to pass therethrough while excluding liquids. Membrane 86 protects the sensor 82 from direct exposure to liquid fuel that may be caught in the vapor recovery line 34 while still allowing accurate readings of the gaseous hydrocarbon content within the vapor recovery line 34. Thus, any membrane which serves this function is appropriate.

Figure 14:
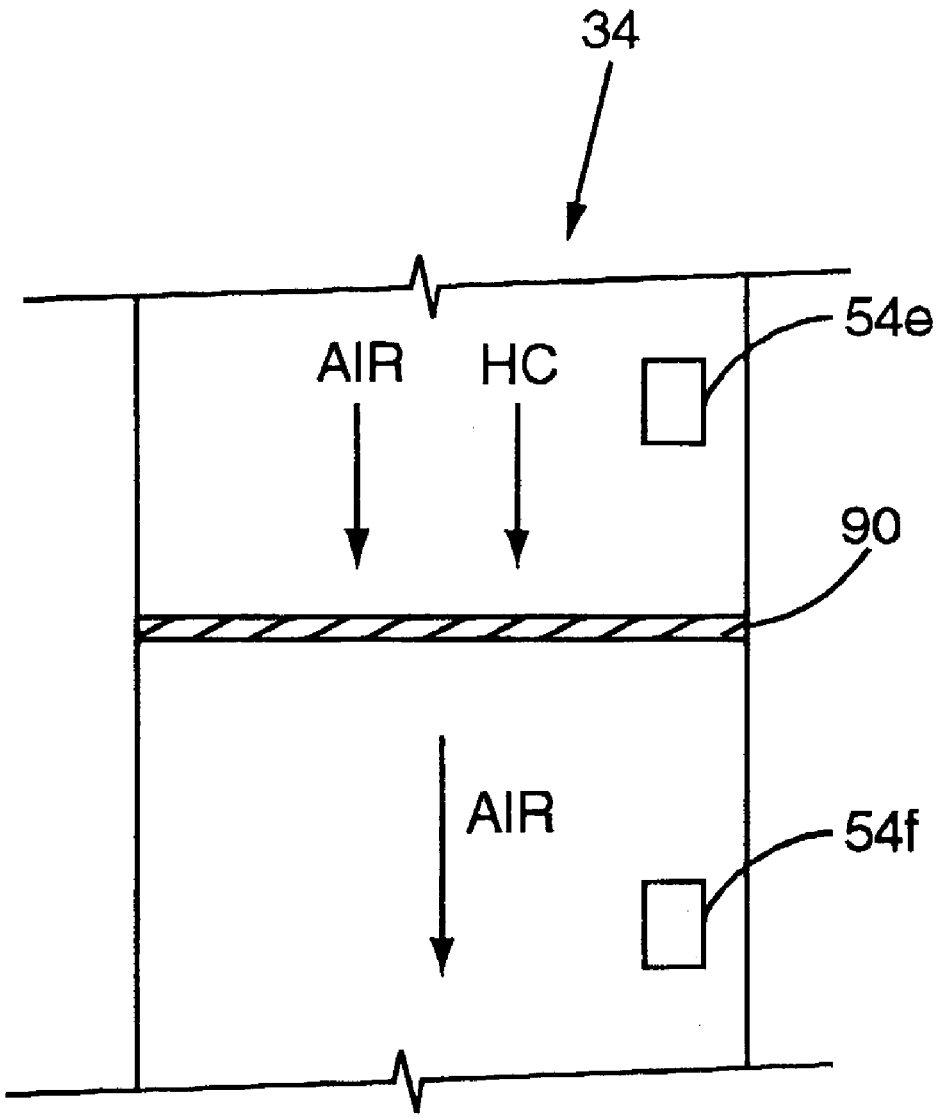
FIG. 14 is a possible alternate use for the sensors of the present invention.

In addition to using a membrane to protect the sensor, it is also possible that the combined sensor 54 is used to check the efficiency of a membrane positioned within the vapor recovery system. For example, as shown in FIG. 14, a membrane 90 may be positioned in a vapor recovery line 34 with a combined sensor 54*e* and 54*f* positioned on either side of the membrane 90. Air and hydrocarbons flow downstream towards the membrane 90, which filters out hydrocarbons. The first combined sensor 54*e* can measure the initial concentration of hydrocarbons, which can then be compared to the post membrane level of hydrocarbons as measured by the second combined sensor 54*f*. This provides an efficiency check on the ability of membrane 90 to filter hydrocarbons. If combined sensor 54*f* provides an anomalous reading, the membrane 90 may be defective, torn, or otherwise not performing as intended. While shown in a vapor recovery line 34, it should be understood that this sort of arrangement may be appropriate in the ventilation system also. Additionally, there is no absolute requirement that two combined sensors 54 be used, one could be positioned upstream or downstream of the membrane 90 as desired or needed. For example, one downstream combined sensor 54 could measure when the membrane had failed. Additionally, the membrane 90 need not filter hydrocarbons, but could rather filter air out of the system. As multiple membranes are contemplated, it is possible that multiple positionings within the vapor recovery system or multiple combined sensors 54 could be used as needed or desired.

Figure 9:
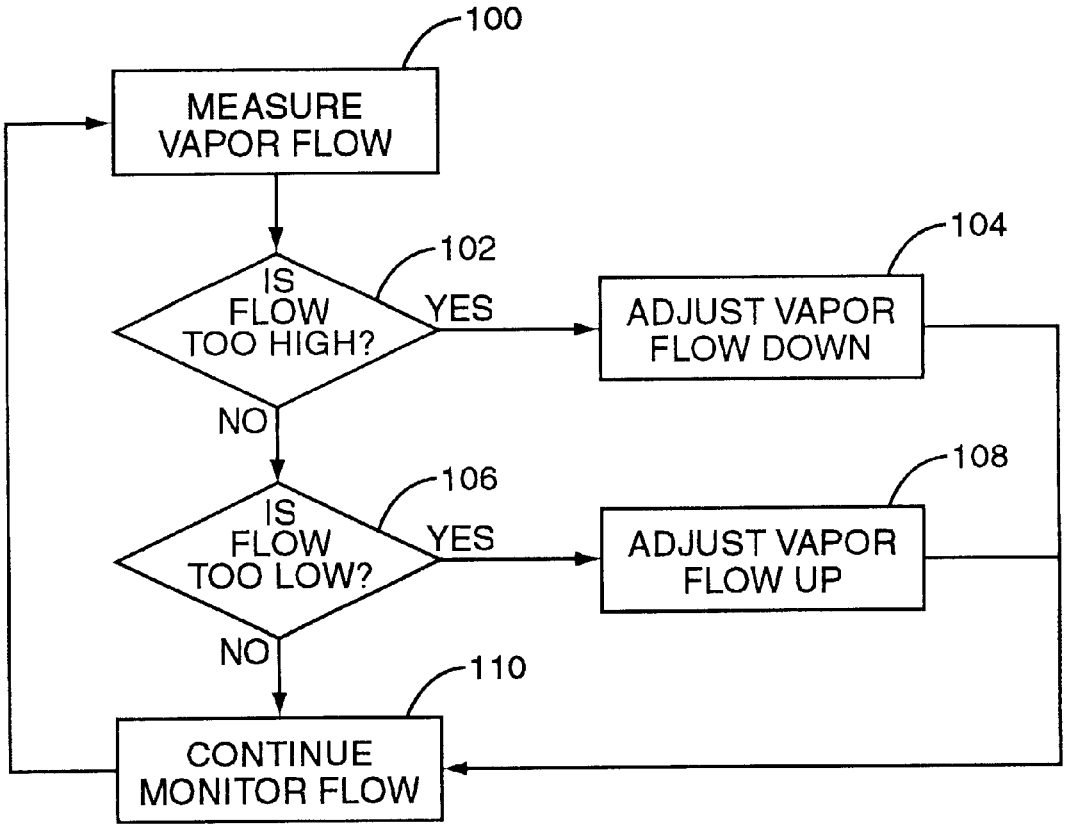
FIG. 9 is a flow chart of the decision making process associated with the vapor flow sensor.

In use, the vapor flow part of the combined sensor 54 is used to control the rate of vapor recovery. Specifically, it goes through a decisional logic as shown in FIG. 9. Combined sensor 54, specifically, the vapor flow monitor 80, begins by measuring the vapor flow (block 100). Because the control system 50 receives input from both the combined sensor 54 and the fuel dispensing meter 56, the control system 50 can make a determination if the vapor flow is too high or otherwise above a predetermined level (block 102) compared to the rate of fuel dispensing. If the answer is yes, the control system 50 may instruct the pump 52 so as to adjust the vapor flow downward (block 104). If the answer is no, the control system 50 determines if the vapor flow is too low (block 106) as compared to some predetermined level. If the answer is yes, then the control system 50 can adjust the vapor recovery rate upward (block 108) by the appropriate instruction to the pump 52. While discussed in terms of making adjustments to the pump 52, it should be appreciated that in systems where there is a constant speed pump and an adjustable valve, the actual adjustment occurs at the valve rather than the pump. Both processes are within the scope of the present invention. If the answer to block 106 is no, then the control system 50 can continue to monitor the vapor flow (block 110) until the end of the fueling transaction. Note that the control system 50 can continue to monitor between fueling operations as well if so desired.

Figure 10:
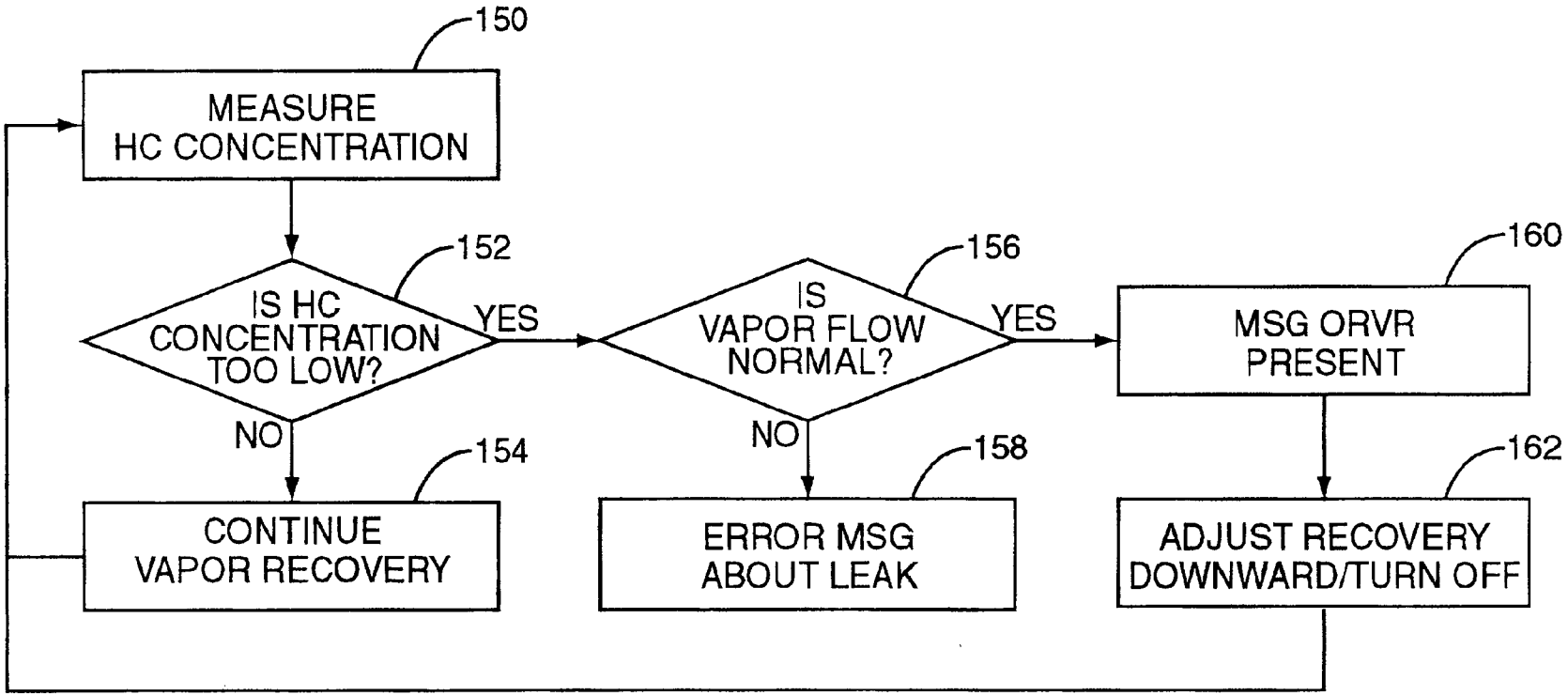
FIG. 10 is a flow chart of the decision making process associated with the hydrocarbon concentration sensor.

The hydrocarbon sensor 82 acts similarly as shown schematically in FIG. 10. Specifically, the sensor 82 measures the hydrocarbon concentration present in the vapor return line 34 (block 150). This can be a direct measurement or an indirect measurement as previously indicated. The control system 50 determines if the hydrocarbon concentration is too low (block 152) as compared to some predetermined criteria. If the answer to block 152 is no, vapor recovery can continue as normal (block 154) with continued monitoring. If the hydrocarbon concentration is considered unusually high, the vapor recovery should also continue as normal. If the answer to block 152 is yes, the control system 50 checks with the vapor flow meter to determine if the vapor flow is normal (block 156). If the answer to block 156 is no, then there may be a possible leak, and an error message may be generated (block 158). If the answer to block 156 is yes, then it is possible that an Onboard Recovery Vapor Recovery (ORVR) system is present (block 160) and the vapor recovery system present in the fuel dispenser 10 may be slowed down or shut off so as to assist or at least prevent competition with the ORVR system.

Figure 11:
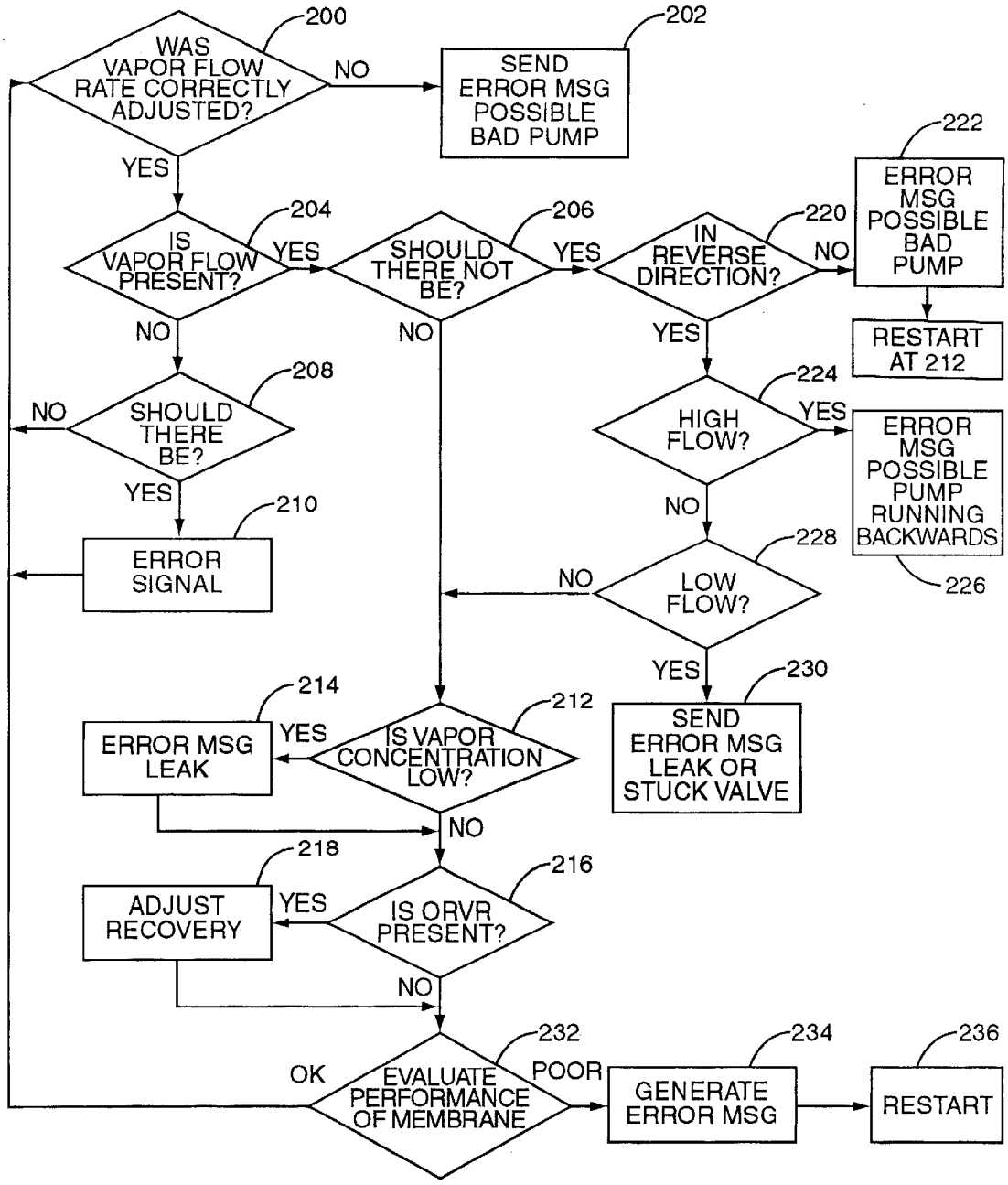
FIG. 11 is a flow chart of the decision making process associated with the diagnostic aspect of the present invention.

In addition to controlling the rate of vapor recovery, the combined sensor 54 can also perform valuable diagnostics to determine compliance with recovery regulations or alert the station operators that a vapor recovery system needs service or replacement. Specifically, the control system 50, through continuous monitoring of the readouts of the combined sensor 54, can determine if the vapor flow rate was correctly adjusted (block 200, FIG. 11). If the answer is no, the flow rate was not properly adjusted within certain tolerances, the control system can generate an error message about a possible bad pump (block 202). If the answer to block 200 is yes, the control system 50 determines if a vapor flow is present (block 204).

If the answer to block 204 is no, there is no vapor flow, the control system 50 determines if there should be a vapor flow (block 208). If the answer to block 208 is yes, then an error signal can be generated pointing to possible causes of the error, namely there is a bad pump 52, the pump control printed circuit board is bad, or there is a nonfunctioning valve (block 210). If the answer to block 208 is no, there is not supposed to be a vapor flow, and one is not present, the program should reset and preferably cycles back through the questions during the next fueling operation or vapor recovery event.

If the answer to block 204 is yes, there is a vapor flow, the control system 50 determines if there is not supposed to be a vapor flow (block 206). If the answer to block 206 is yes, there is a flow and there is not supposed to be a flow, the control system 50 determines if the vapor flow is in the reverse direction (block 220). If the answer to block 220 is no, the flow is not reversed, then the control system may generate an error message that the pump 52 may be bad (block 222), and then the diagnostic test continues as normal at block 212. If the answer to block 220 is yes, the control system 50 determines if the flow is a high flow as classified by some predetermined criteria (block 224). If the answer to block 224 is yes, then the control system 50 may generate an error message that the pump may be running backwards (block 226). If the answer to block 224 is no, then the control system 50 determines if the flow is a low flow as classified by some predetermined criteria (block 228). If the answer is yes, then the control system 50 may generate an error message that there is a possible leak or a stuck valve (block 230). If the answer to block 228 is no, then a general error message may be created by the control system 50 and the diagnostic test continues at block 212.

If the answer to block 206 is no, (i.e., there is a vapor flow and there is supposed to be one) then the diagnostic test continues as normal by proceeding to block 212. At block 212, control system 50 determines if the vapor, specifically, the hydrocarbon concentration is too low. If the answer is yes, the hydrocarbon concentration is too low, then an error message indicating a possible leak may be generated (block 214). If the answer to block 212 is no, then the control system 50 determines if an Onboard Recovery Vapor Recovery (ORVR) vehicle is being fueled (block 216). This determination is made by comparing the rate of fueling versus the rate of recovery versus the hydrocarbon concentration. If predetermined criteria are met for all of these parameters, it is likely that an ORVR vehicle is present. If the answer is yes, then the control system 50 may adjust the recovery efforts accordingly to limit competition between the two vapor recovery systems (block 218). If the answer to block 216 is no, the performance of the membrane 86 is evaluated if such is present (block 232). If the membrane 86 is functioning properly, then the diagnostics repeat beginning at block 200. Alternatively, the diagnostics may be halted until the next fueling transaction or the next vapor recovery event. If the membrane is not functioning properly, an error message may be generated (block 234) and the diagnostics restart (block 236).

Error messages may appear as text on a computer remote to the fuel dispenser through a network communication set up. Such a computer could be the G-SITE® as sold by the assignee of the present invention. Communication between the fuel dispenser 10 and the remote computer can be wireless or over conventional wires or the like as determined by the network in place at the fueling station. Additionally, there can be an audible alarm or like as desired or needed by the operators of the fueling station.

The present invention is well suited to meet the reporting requirements of CARB or other state regulatory schemes. The information provided by the combined sensor 54 can be output to a disk or to a remote computer, regardless of whether an error message has been generated. This information could be stored in a data file that an operator could inspect at his leisure to track the performance of the vapor recovery system. Additionally, percentages of fueling transactions involving ORVR vehicles could be estimated based on how frequently such a vehicle was detected. Other information may easily be collated or extrapolated from the information gathered by the combined sensor 54. The placement of multiple combined sensors 54 within the vapor recovery system or the ventilation system allows close monitoring of the various elements of the respective systems so that problems can be isolated efficiently and the required maintenance, repair or replacement performed in a timely fashion. This will help the fueling station operator comply with the increasingly strict regulatory schemes associated with a fuel dispensing environment.

In other embodiments of the present invention, fuel dispenser 10 is configured to adjust its vapor recovery system if vapor flow 206 to liquid flow (V/L) ratio is not as desired during the fueling process. As previously discussed, fuel dispenser 10 and its vapor recovery system control the amount of vapor returned to UST 40. Control system 50 may control its vapor recovery system to increase or decrease vapor flow being returned to UST 40 in response to its calculations of the V/L ratio.

Figure 15:
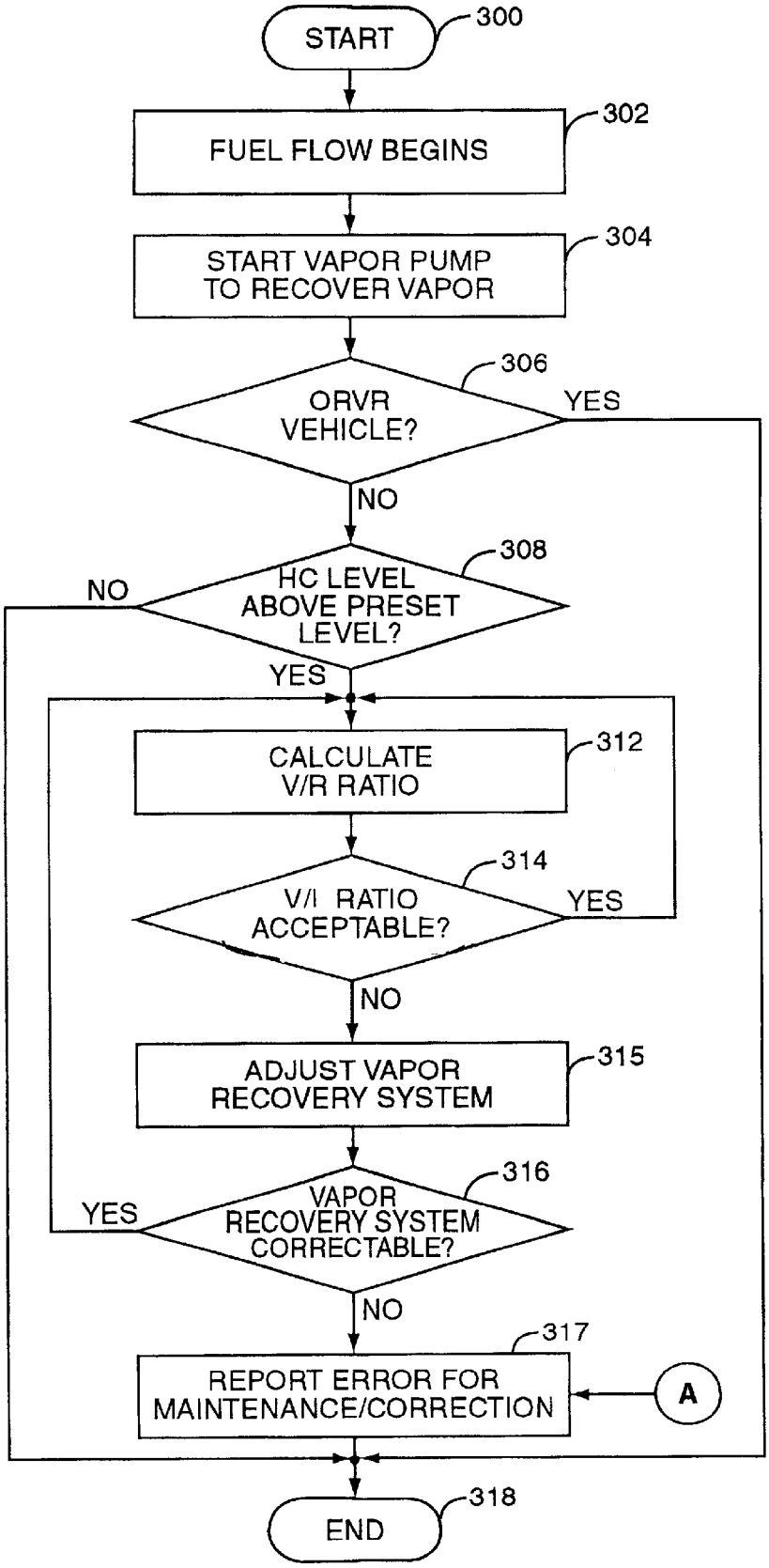
FIG. 15 is a flow chart illustration of a fuel dispenser adjusting its vapor recovery system if it determines that its V/L ratio is not acceptable.

FIG. 15 illustrates this overall process. The process starts (block 300) and fuel flow begins (block 302). Control system 50 starts vapor recovery pump 52, and the vapor recovery system returns vapor emitted from vehicle 12 in correlation to fuel being dispensed into vehicle 12 (block 304). Hydrocarbon sensor 54 measures the hydrocarbon content of vapor being return through vapor return line 34 to determine if vehicle 10 is an ORVR-equipped vehicle, as discussed above and as exemplified in U.S. Pat. No. 5,782,745 (decision 306). If vehicle 10 is ORVR-equipped, the process ends (block 318). If vehicle 10 is not ORVR-equipped, control system 50 determines if the hydrocarbon content of vapor is above a threshold level in order to determine if a proper V/L ratio can be calculated (decision 308). Control system 50 calculates the V/L ratio by dividing the liquid flow rate by the vapor flow rate, using vapor flow meter 54 (block 312). If V/L ratio acceptable (decision 314), the process repeats by continuing to calculate the V/L ratio (block 312) and checking to see if the V/L ratio is acceptable (block 314) until the fueling process ends. If the V/L ratio is not acceptable, control system 50 adjusts the vapor recovery system to attempt to bring fuel dispenser 10 V/L ratio into acceptance (block 315). If control system 50 is successful (decision 316), the process repeats by continuing to calculate the V/L ratio (block 312) and checking to see if the V/L ratio is acceptable (block 314) until the fueling process ends. If control system 50 is unsuccessful (decision 316), an error is reported (block 317) and the process ends (block 318). Such error may be an alert, a flag, a notification at fuel dispenser 10 or remote location from fuel dispenser 10. Or such error may cause control system 50 to shut down fuel dispenser 50 or to only allow fuel dispenser 50 to fuel ORVR-equipped vehicles 12.

One manner of control system 50 determining if the V/L ratio of fuel dispenser 10 is correct is by comparing V/L ratio calculations to an acceptable range. A typical range of acceptable V/L ratios may be between 0.7 and 1.1, but preferably 1.0. If a V/L ratio is calculated that is outside of a desired range, any number of correction measures may be taken, as discussed above.

Figure 16:
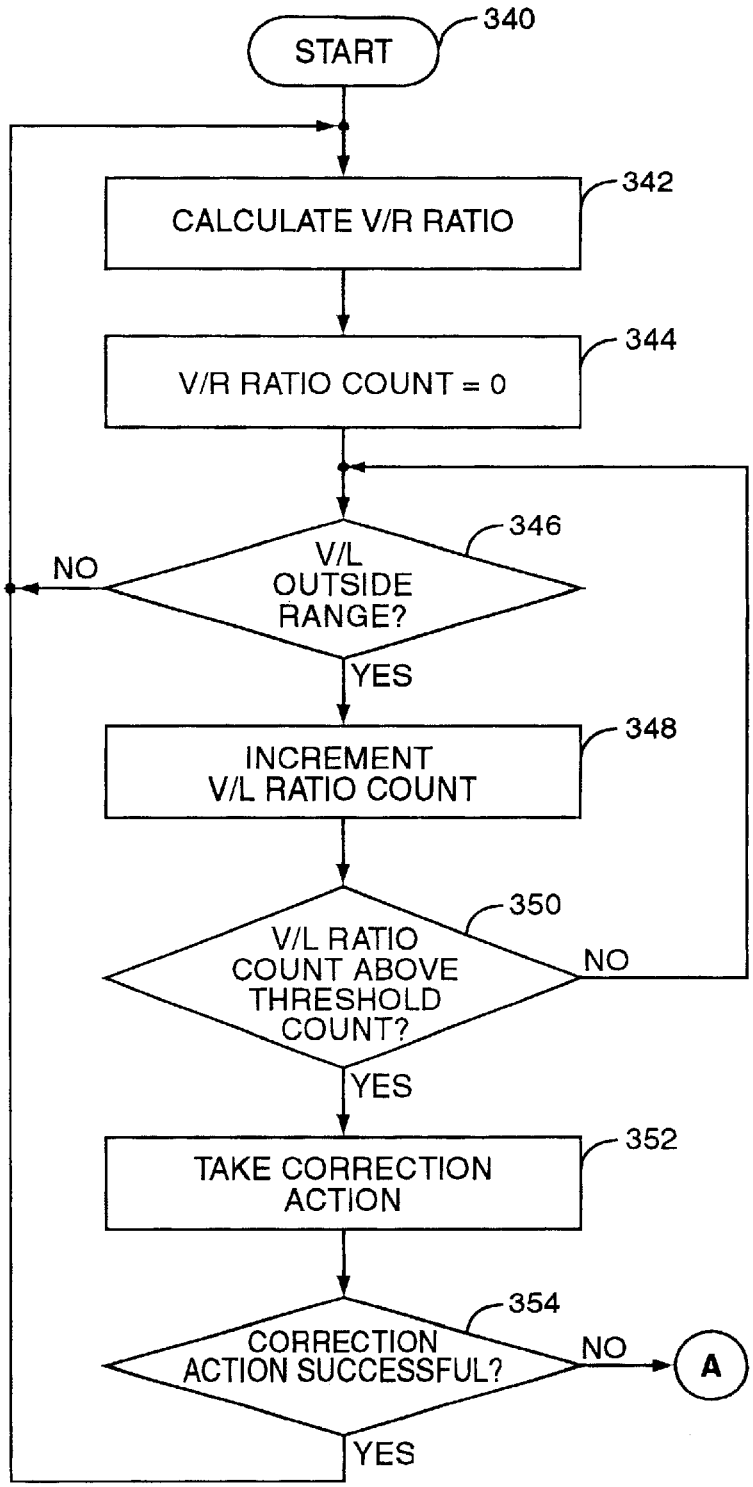
FIG. 16 is a flow chart illustration of a fuel dispenser adjusting its vapor recovery system if it determines that more than one successive V/L ratio is outside acceptable limits.
Figure 17:
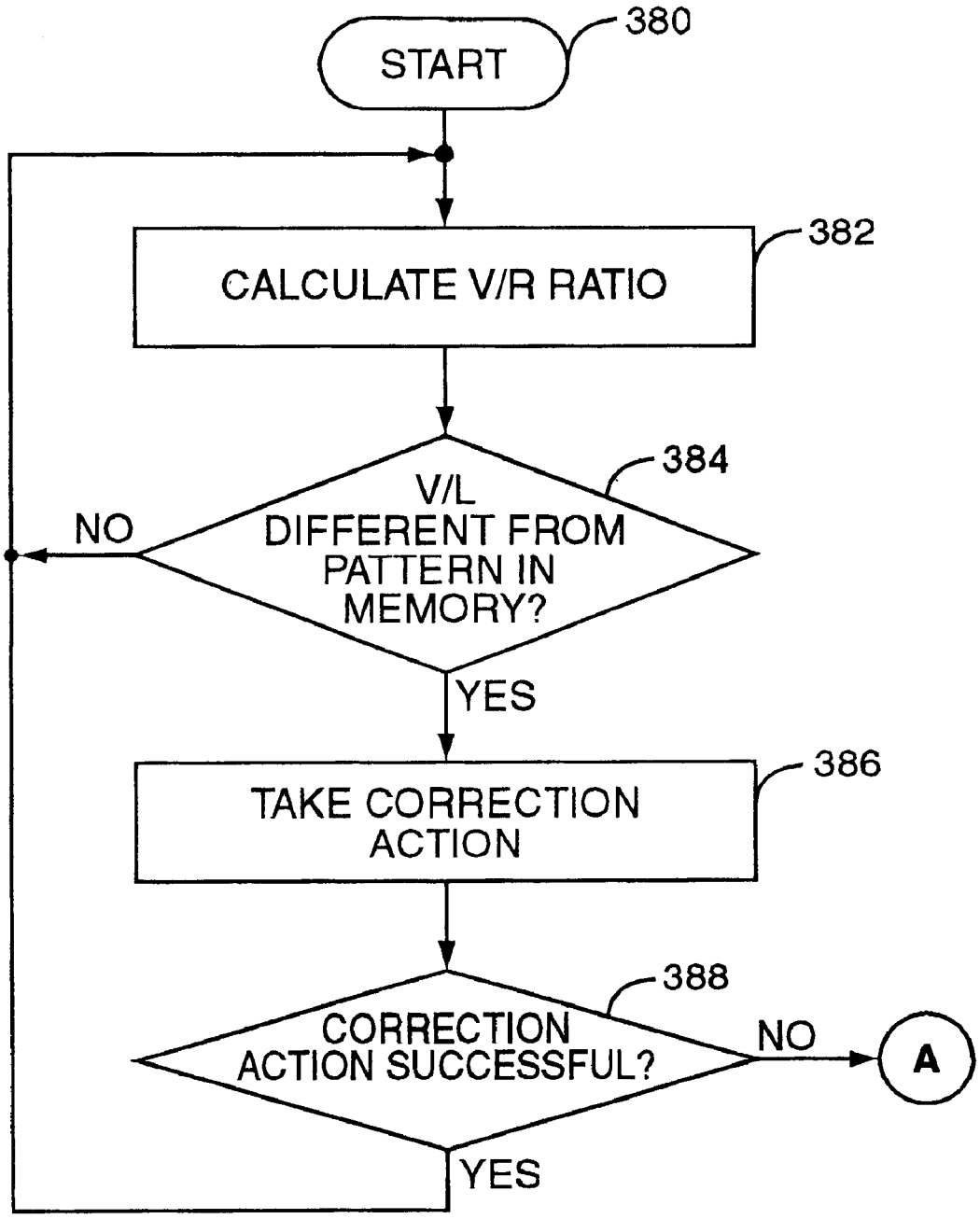
FIG. 17 is a flow chart illustration of a fuel dispenser adjusting its vapor recovery system if it determines that V/L ratios calculated over time deviate from a pattern.

FIGS. 16 and 17 illustrate two specific embodiments of the overall process illustrated in FIG. 15, and specifically the manner in which control system 50 determines if the V/L ratio is correct (block 314 of FIG. 15). The process starts (block 340) and control system 50 calculates the V/L ratio (block 342). A V/L ratio count indicating the number of V/L ratio calculations that are in error is set to zero (block 344). Control system 50 determines if the V/L ratio is outside a range (decision 346). If the calculated V/L ratio is within a desired range (decision 346), the process repeats by calculating the V/L ratio (block 342). If the calculated V/L ratio is outside of a desired range (decision 346), the V/L ratio count is incremented (block 348). If the V/L ratio count is above a threshold amount (decision 350), this means that consecutive V/L ratio calculations at a threshold number of the V/L ratio calculations were outside an acceptable range. In this instance, control system 50 takes corrective action (block 352) to adjust the vapor recovery system to bring the fuel dispenser 10 V/L ratio within acceptable limits. Corrective action taken by control system 50 may be any type of measure to attempt to bring the V/L ratio of fuel dispenser 10 into an acceptable range, including, but not limited to increasing or decreasing vapor recovery pump 52 speed, opening or closing a controlled valve or vapor valve, or any other method that will increase of decrease the amount of vapor being returned to UST 40 to affect the V/L ratio. After such corrective action is taken, control system 50 determines if such action was successful (i.e., bringing the V/L ratio calculation within an acceptable range (decision 354)). If not, the process returns to FIG. 15 (block 316) to report an error. If so, the process continues by continuing to calculate the V/L ratio of fuel dispenser 10 (block 342).

FIG. 17 illustrates another embodiment for determining if the V/L ratio of fuel dispenser 10 is acceptable. The process starts (block 380), and control system 50 calculates the V/L ratio of fuel dispenser 10. Theoretical V/L ratio calculations with respect to time are stored in memory in fuel dispenser 10 or other location beforehand to form a typical pattern. During different stages of fuel dispensing, based on factors such as temperature, gallons dispensed, speed at which fuel is dispensed, etc., the V/L ratio may change. Control system 50 compares the actual V/L ratio calculations over time to the pattern in memory to determine if V/L ratio of fuel dispenser 10 is within acceptable limits. If the V/L ratio deviates from the pattern (decision 384) in an unacceptable fashion, control system 50 may take any number of corrective action (block 386), as discussed previously. If the corrective action is successful (decision 388), the process repeats (block 382). If not, the process reports an error (block 316 in FIG. 15), as previously discussed.

While a particular flow chart has been set forth elaborating on the procedure by which the control system 50 can check the various functions of the vapor recovery system, it should be appreciated that the order of the questions is not critical. The present flow chart was given by way of illustration and not intended to limit the use of the vapor recovery system, and particularly the combined sensor 54 to a particular method of performing diagnostic tests.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A fuel dispenser having a vapor recovery system, comprising:

a) a fuel delivery system adapted to deliver fuel along a fuel delivery path from a storage tank to a vehicle during a fueling operation;

b) a vapor recovery system having a vapor recovery path to deliver vapors expelled from the vehicle to the storage tank when fuel is delivered during a fueling operation;

c) a vapor flow sensor for determining a vapor flow rate in said vapor recovery path; and d) a control system for calculating a V/L ratio and comparing said V/L ratio to a range of acceptable V/L ratios and taking corrective action on said vapor recovery system if said V/L ratio is not within said acceptable V/L ratio.

2. The fuel dispenser of claim 1, wherein said corrective action is changing the speed of a vapor pump under control of control system that dictates that amount of said vapor flow rate in said vapor flow path.

3. The fuel dispenser of claim 1, wherein said corrective action is adjusting a valve under control of control system that dictates the amount of said vapor flow rate in said vapor flow path.

4. The fuel dispenser of claim 1, wherein said range of acceptable V/L ratios is 0.7 to 1.1.

5. The fuel dispenser of claim 1, wherein said control system reports an error if said corrective action is unsuccessful.

6. A fuel dispenser having a vapor recovery system, comprising:

a) a fuel delivery system adapted to deliver fuel along a fuel delivery path from a storage tank to a vehicle during a fueling operation;

b) a vapor recovery system having a vapor recovery path to deliver vapors expelled from the vehicle to the storage tank when fuel is delivered during a fueling operation;

c) a vapor flow sensor for determining a vapor flow rate in said vapor recovery path; and d) a control system for calculating successive V/L ratio calculations and adjusting said vapor recovery system if all of said successive V/L ratios are not within an acceptable V/L ratio.

7. The fuel dispenser of claim 6, wherein said successive V/L ratio calculations is at least ten V/L ratio calculations.

8. The fuel dispenser of claim 6, wherein said control system reports an error if said corrective action is unsuccessful.

9. The fuel dispenser of claim 6, wherein said corrective action is changing the speed of a vapor pump under control of control system that dictates that amount of said vapor flow rate in said vapor flow path.

10. The fuel dispenser of claim 6, wherein said corrective action is adjusting a valve under control of control system that dictates the amount of said vapor flow rate in said vapor flow path.

11. A fuel dispenser having a vapor recovery system, comprising:

a) a fuel delivery system adapted to deliver fuel along a fuel delivery path from a storage tank to a vehicle during a fueling operation;

b) a vapor recovery system having a vapor recovery path to deliver vapors expelled from the vehicle to the storage tank when fuel is delivered during a fueling operation;

c) a vapor flow sensor for determining a vapor flow rate in said vapor recovery path; and d) a control system for comparing V/L ratio calculations to a pattern in a memory in said control system and adjusting said vapor recovery system if said V/L ratio calculations deviate from said pattern.

12. The fuel dispenser of claim 11, wherein said control system reports an error if said corrective action is unsuccessful.

13. The fuel dispenser of claim 11, wherein said corrective action is changing the speed of a vapor pump under control of control system that dictates that amount of said vapor flow rate in said vapor flow path.

14. The fuel dispenser of claim 11, wherein said corrective action is adjusting a valve under control of control system that dictates the amount of said vapor flow rate in said vapor flow path.

15. A method for controlling a vapor recovery system in a fuel dispenser, said method comprising the steps of:

a) delivering fuel to a vehicle;

b) recovering vapor through a vapor recovery line;

c) calculating a V/L ratio of the vapor recovery system;

d) comparing said V/L ratio to a range of acceptable V/L ratios; and e) adjusting the rate of vapor recovery if said V/L ratio is not within said range of acceptable V/L ratios.

16. The method of claim 15, wherein said range of acceptable V/L ratios is 0.7 to 1.1.

17. The method of claim 15, further comprising the step of reporting an error if said adjusting is unsuccessful.

18. The method of claim 15, wherein said adjusting further comprises changing the speed of a vapor recovery pump that controls said recovering.

19. The method of claim 15, wherein said adjusting further comprises changing the opening of a valve that controls said recovering.

20. A method for controlling a vapor recovery system in a fuel dispenser, said method comprising the steps of:

a) delivering fuel to a vehicle;

b) recovering vapor through a vapor recovery line;

c) calculating a plurality of successive V/L ratios of the vapor recovery system; and d) adjusting the rate of vapor recovery if two or more of said plurality of successive V/L ratios is not within a range of acceptable V/L ratios.

21. The method of claim 20, further comprising the step of reporting an error if said adjusting is unsuccessful.

22. The method of claim 20, wherein said adjusting further comprises changing the speed of a vapor recovery pump that controls said recovering.

23. The method of claim 20, wherein said adjusting further comprises changing the opening of a valve that controls said recovering.

24. The method of claim 20, wherein said plurality of successive V/L ratios is at least ten.

25. A method for controlling a vapor recovery system in a fuel dispenser, said method comprising the steps of:

a) delivering fuel to a vehicle;

b) recovering vapor through a vapor recovery line;

c) calculating V/L ratio of the vapor recovery system over time;

d) comparing said V/L ratios to a pattern; and e) adjusting the rate of vapor recovery if said calculated V/L ratios deviate from said pattern.

26. The method of claim 25, further comprising the step of reporting an error if said adjusting is unsuccessful.

27. The method of claim 25, wherein said adjusting further comprises changing the speed of a vapor recovery pump that controls said recovering.

28. The method of claim 25, wherein said adjusting further comprises changing the opening of a valve that controls said recovering.

* * * * *